United States Patent [19]

Johnson, Sr.

[11] Patent Number: 4,798,936

[45] Date of Patent: Jan. 17, 1989

[54] WATERBED HEATER

[76] Inventor: Arthur K. Johnson, Sr., 655 S. Mesa Dr., #1041, Mesa, Ariz. 85202

[21] Appl. No.: 896,770

[22] Filed: Aug. 14, 1986

[51] Int. Cl.[4] ..... H05B 1/02

[52] U.S. Cl. ..... 219/217; 219/212; 219/528; 219/549

[58] Field of Search ..... 219/212, 217, 211, 528, 219/529, 548, 549, 494, 531

[56] References Cited

U.S. PATENT DOCUMENTS

| | | | |
|---|---|---|---|
| 4,245,149 | 1/1981 | Fairlie | 219/528 |
| 4,540,878 | 9/1985 | Sato | 219/212 |
| 4,661,689 | 4/1987 | Harrison | 219/528 |

*Primary Examiner*—A. D. Pellinen

*Assistant Examiner*—Leon K. Fuller

*Attorney, Agent, or Firm*—Louise S. Heim

[57] ABSTRACT

A heater adapted for placement under the mattress of a waterbed consists of a flexible laminated pad having an upper layer of resistive elements embedded in electrical insulating material, and several subjacent layers of heat-reflective and thermal insulating materials. All of the layers are encased in a protective waterproof sheath. The pad may be connected in parallel with one or more similar pads and a heat sensor may be associated with each pad. In one embodiment, a control circuit is provided for supplying power to all of the pads simultaneously when all of the heat sensors detect that the temperature of the mattress has dropped below a predetermined value. In another embodiment, power may be supplied to each pad independently of the other pads.

35 Claims, 3 Drawing Sheets

WATERBED HEATER

BACKGROUND OF THE INVENTION

1. Field of the Invention

This invention relates generally to the field of heaters adapted for placement under a water bed mattress, more particularly to a flexible laminated heating pad having an associated temperature control unit.

2. Description of the Prior Art

Waterbed heaters typically consist of solid resistance wires or etched aluminum resistance elements which have been embedded or imprinted in a flat flexible mylar mat and sealed in a protective PVC sheath. Generally, the resistance elements are laid out in a serpentine pattern through the mat.

Numerous difficulties have been experienced with the aforementioned conventional heaters. First and foremost of the difficulties is that the heaters consume a tremendous amount of energy, since they have to heat anywhere from about 50 gallons of water for a child-sized waterbed to over 350 gallons of water for a king size bed. The high watt density of the heaters not only results in high costs to the waterbed owner, but also tends to accelerate waterbed mattress aging and can lead to electrical malfunctions. In addition, the heat distribution in conventional heaters tends to be uneven, causing "hot spots" in certain parts of the waterbed, while other parts are insufficiently heated. This may result in still more power consumption, since the waterbed user may be inclined to turn up the thermostat in order to heat up the cool parts of the mattress, even though the overall average temperature of the mattress might be satisfactory. Another problem of the prior art heaters is that because they have separate cables running from the mattress and heat sensor to the thermostat and the power supply they tend to be awkward and unwieldy. The cables cause lumps underneath the waterbed mattress, tend to tangle with one another, and make the pads more difficult to roll up for storage and transport. Thus, a need exists in the art for a new improved waterbed heater which heats the water in the waterbed mattress more efficiently and at the same time is less cumbersome and unwieldy than the prior art heaters.

BRIEF SUMMARY OF THE INVENTION

The waterbed heater according to the present invention overcomes the shortcomings of the prior art by providing layers of reflective and insulating materials underneath a laminated heating element. This has been found to significantly improve the efficiency of the heater since it eliminates heat loss through the bottom of the element. In previous heaters, as much as 50% of the heat was wasted since it radiated downwardly and was absorbed in the bed frame, but in the present invention the reflective and insulating layers ensure that nearly all of the heat is radiated upwardly; thus there is virtually no waste.

Also, in a preferred embodiment of the invention, the conventional serpentine pattern of the resistance elements in the laminated mat is replaced with a quilted, "honeycomb" pattern of paths connected in parallel with one another. The honeycomb pattern enables a greater portion of the surface area of the mat to be covered by resistive material, and thus allows for a far more even distribution of heat than the serpentine pattern utilized in conventional heaters. In addition, the reflective material beneath the resistive pattern is embossed or quilted in such a way that small pockets of air are created underneath the resistive elements. These pockets form an extra layer of thermal insulation which further reduces the amount of heat loss through the bottom of the pad and increases the thermal efficiency.

In another embodiment of the invention, a plurality of the heating pads are connected in parallel to one another, and each pad is connected to its own heat sensor. The advantages of having a plurality of heating pads and sensors, rather than a single pad and sensor will depend on the particular heater control circuit being utilized. In one instance, for example, the sensors may be connected in series to one another and to a conventional thermostat which controls the energization of a switch or relay which when closed applies conventional 110 VAC to the heating pads. Because the sensors are connected in series, the switch or relay will be closed only when all of the sensors detect that an increase in temperature is needed, and will open as soon as any one of the sensors detects that the desired temperature has been reached. The advantage of this particular control arrangement would be that the thermostat is governed by the overall average temperature of the waterbed mattress rather than by a single temperature reading from what might be a hot or cold spot in the bed. This makes it easier for the waterbed user to maintain a steady, comfortable temperature throughout the mattress. In another instance, however, it may be desirable for one portion of the mattress to be maintained at a different temperature from another part of the mattress. In such a case, the mattress may be split so there is no fluid communication between the mattress parts, and the heating pads can be positioned such that one pad is under each mattress part. In this case, the sensors would be attached in parallel rather than in series, and each sensor would be connected to its own thermostat and switch or relay so that heat could be applied to any one of the pads independently of what was happening in the other pad or pads. This would enable individuals with different temperature preferences to sleep in the bed simultaneously, with each individual able to adjust the temperature in his or her side of the bed to his or her own satisfaction without affecting the temperature in the rest of the bed.

Still another feature of the invention is that all of the wires from the thermostat and the transformer to the heater are combined in a single cable. Thus, the lumps and tangling which result from having a number of cables are eliminated, resulting in a pad which is more convenient to store and transport.

Accordingly, it is an object of the present invention to provide a new and useful waterbed heating unit in which heat loss through the bottom of the pad is reduced, therefore maximizing thermal efficiency.

Another object of the invention is to provide a waterbed heating unit in which heat is evenly distributed over the surface area of the unit.

Still another object of the invention is to provide a waterbed heating unit with a minimum number of electrical cables, so that the lumps and tangling caused by a large number of cables are eliminated, making the unit easy to roll up for storage and transport.

The foregoing and other objects of the invention, as well as the invention itself, may be more fully understood from the following description when read in conjunction with the following drawings.

DESCRIPTION OF THE PREFERRED EMBODIMENTS

Figure 1:
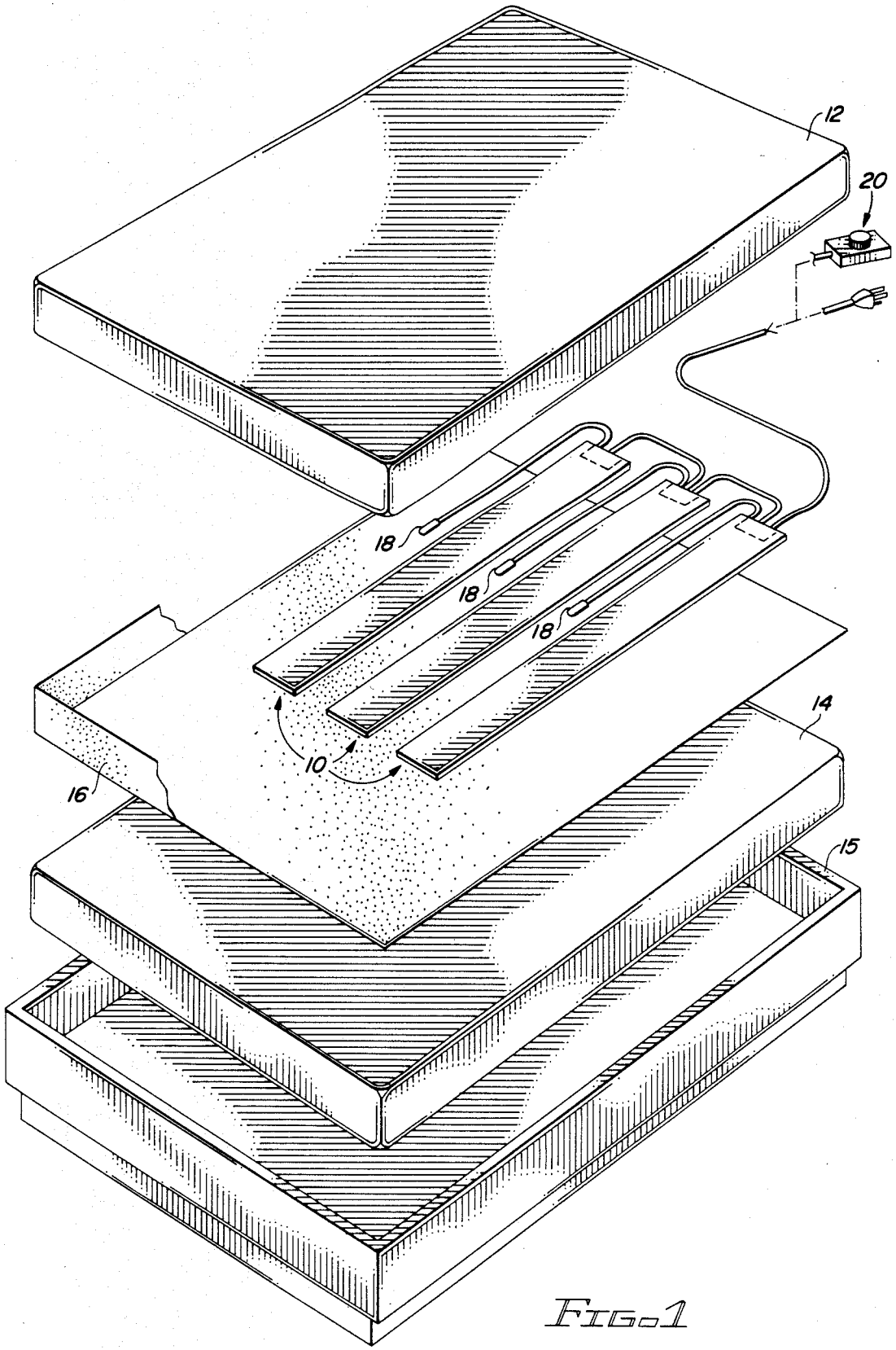
FIG. 1 is an exploded perspective view showing a plurality of the heaters of the present invention connected together and placed under a waterbed mattress.

Referring more particularly to the drawings, FIG. 1 illustrates a plurality of the heating pads 10 of the present invention connected in parallel to one another and sandwiched between waterbed mattress 12 and some type of support 14 such as a box spring, which is itself supported in a conventional waterbed frame 15. A thin pad of reflective material 16 may be placed between the mattress support 14 and the heating pad 10 in order to reflect heat upwardly through the mattress 12 rather than allowing it to radiate downwardly and to become lost in the mattress 14. Reflective pad 16 may be provided with upstanding edges which enable it to duplicate the function of a conventional waterbed liner, protecting the mattress support and frame from water damage. In order to further ensure that the heat radiates primarily upwardly rather than downwardly, the bottom side of the waterbed mattress 12 may be painted black or another dark, heat absorbent color. Each of the heating pads 10 has its own associated heat sensor 18, which is essentially a switch for automatically closing the heater circuit when the temperature of the mattress is to low, and opening the circuit when the desired temperature has been reached.

Figure 2:
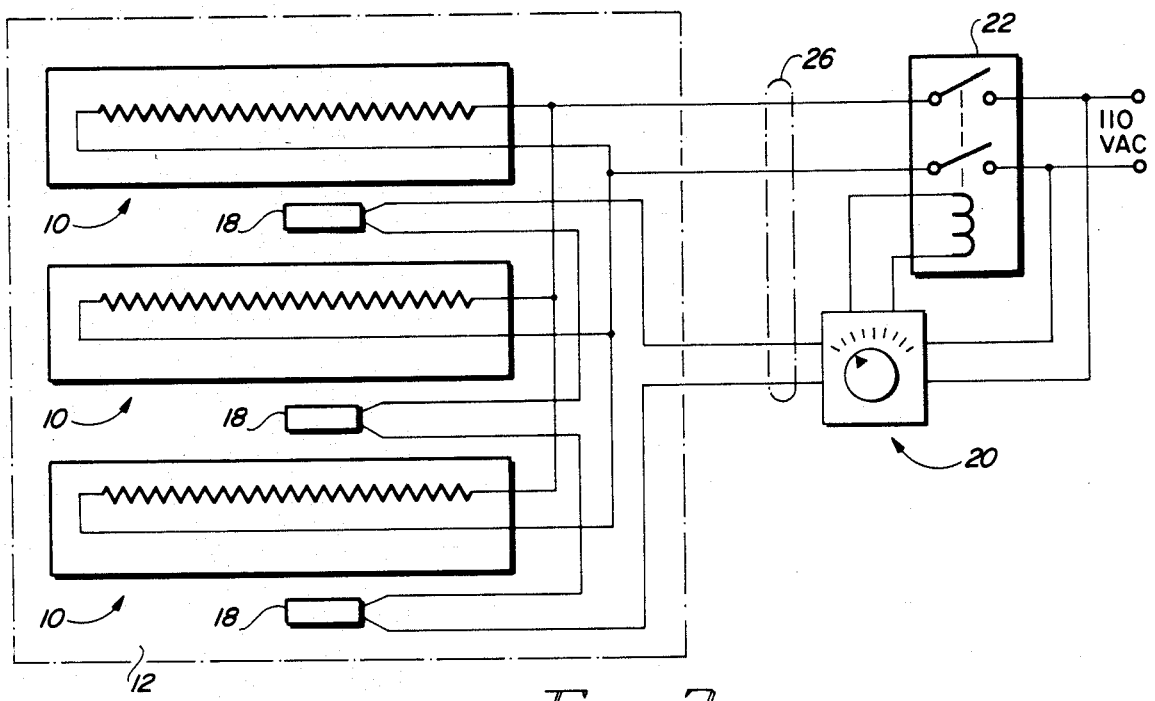
FIG. 2 is a circuit diagram showing a plurality of the heater pads of the present invention connected to a temperature control unit.

In FIG. 2, the heat sensors 18 are shown connected in series to one another, and to a conventional thermostat 20. Any type of thermostat may be used, but one in particular which has been found suitable for this application is the thermostat marketed under the trade name "Duratherm Comfort System" by Thermafoil. Thermostat 20 controls the energization of a switch means 22, which when closed applies conventional 110 VAC to the heating pads 10. Switch means 20 is show as a mechanical relay in FIG. 2. However, solid state switches can also be used as is well known in the art. Because the heat sensors 18 are connected in series to one another, the circuit including the sensors 18 and the thermostat 20 will not be closed unless all the heat sensor switches 18 are closed. Thus, electrical power will not be supplied to the heating pads 10 unless all of the sensors detect that the temperature in the mattress is too low. This ensures that the heater is controlled by the overall average temperature in the mattress and not by the temperature in a single, unrepresentative hot or cold spot as could be the case when only one sensor is used.

Figure 3:
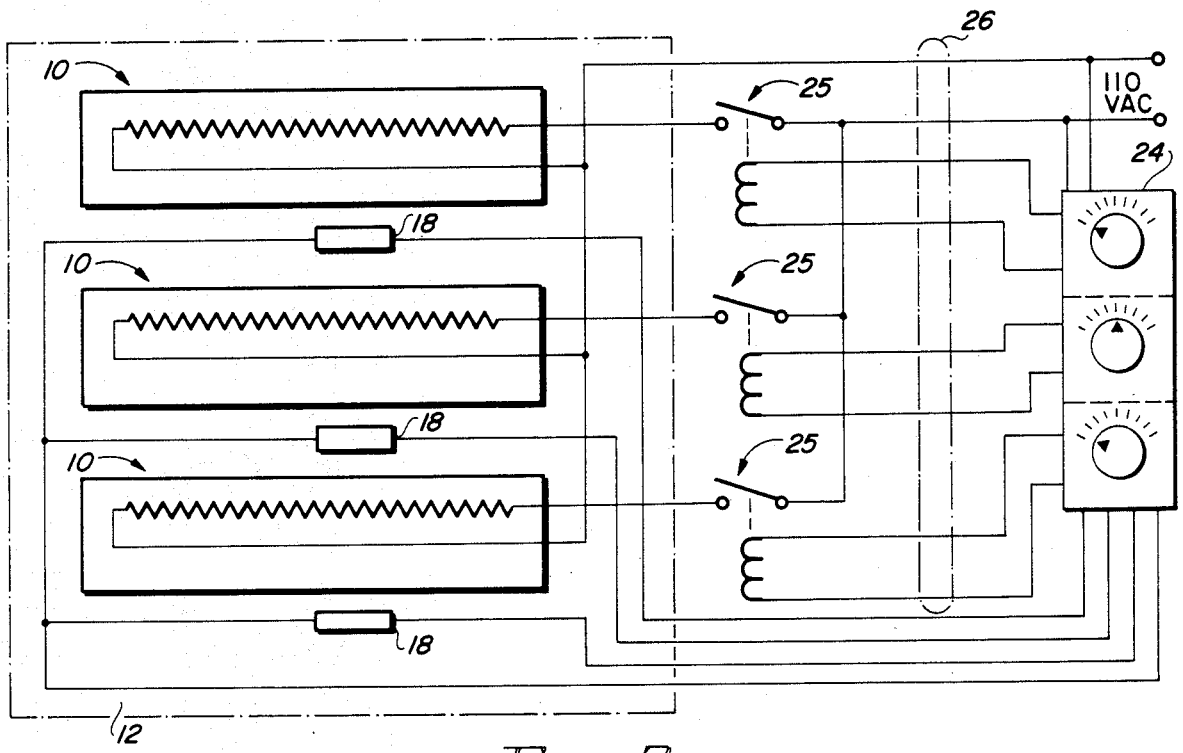
FIG. 3 is an alternative circuit for connecting a plurality of the heater pads to a temperature control unit.

An alternative circuit is shown in FIG. 3, which shows the heat sensors 18 connected to one another in parallel rather than in series. The sensors 18 are connected in parallel with a thermostat 24. Thermostat 24 may simply be a plurality of conventional thermostats such as thermostat 20 shown in FIG. 2 (ie. the "Duratherm Comfort System" by Thermafoil Products Inc.), the thermostats being grouped together in a single housing, with each pad being coupled to a different thermostat, or the thermostat 24 could include more sophisticated circuitry for comparing the output from each of the sensors and controlling the input to the heating pads accordingly. Such circuitry could easily be designed by the routineer average skill in the art, and will not be further described, as it is not the subject of this invention. In any case, regardless of the specific type of thermostat 24, the thermostat 24 is connected in parallel to a plurality of switch means 25, one switch means for each heating pad 10. Again, although the switch means are shown in FIG. 3 as mechanical relays, solid state switches can also be used. The fact that the sensors 18 and the thermostat 24 are connected in parallel, and that there is a separate relay 25 connected in series to each heating pad 10, enables the waterbed user to control the power input into each pad separately, and thus makes the circuit ideal for applications where different temperatures are desired in different parts of the bed.

Note that in both FIG. 2 and FIG. 3, the connectors from the heating pads 10 and the heat sensors 18 are symbolically shown to be embedded in a single cable 26. This eliminates the lumps and cable tangling which tend to result from multiple cable arrangements.

Figure 5:
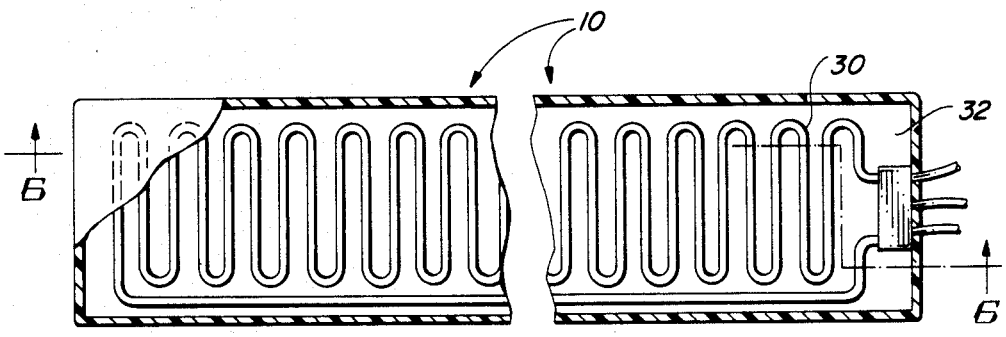
FIG. 5 is a top view of a single heating pad in another embodiment of the invention, with a protective covering partially broken away.
Figure 6:
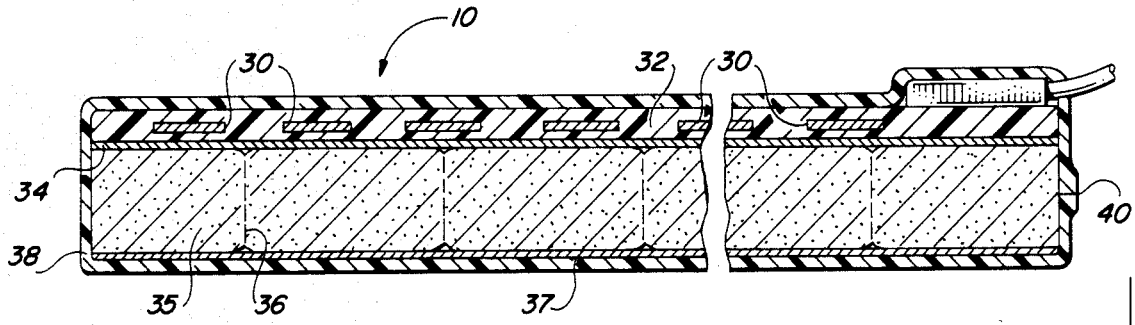
FIG. 6 is a sectional view taken through line 6—6 of FIG. 4.

FIGS. 5 and 6 show a preferred embodiment of one of the heating pads 10 of the present invention, which may be used either individually or in parallel with a plurality of similar pads as shown in FIGS. 1-3. The heater comprises a layer of resistive material 30 such as aluminum which is laid out in a serpentine pattern and embedded in a layer of electrical insulating material 32 such as Mylar or polyethylene. A thin sheet of heat reflective material 34 such as aluminum foil lies below the layer of insulating material 32, for reflecting heat upwardly through the waterbed mattress. Below the reflective layer is a thermal barrier 35 consisting of a thermal insulating material such as foam or compressed cork. Preferably, the thermal barrier layer 35 is notched as shown at 36 in order to make the pad flexible and easy to roll up for storage. Beneath the thermal barrier layer is another layer of reflective material 37. The entire heating unit 10 is encased in a protective sheath 38 made from a waterproof material such as PVC in order to protect the waterbed user from the risks of electrical shock which would occur if the resistive elements were to get wet. The sheath 38 may contain an evacuation orifice 40 through which a source of suction may be applied in order to remove air from the interstices of the barrier layer 35 and thus even further improve its thermal insulating qualities. Note the reflective layers 34 and 37 essentially eliminate the need for a separate reflective pad 16 as shown in FIG. 1, but the waterbed owner may nevertheless keep the reflective pad 16 as a backup to further reduce the amount of heat loss through the bottom of the pad.

Figure 4:
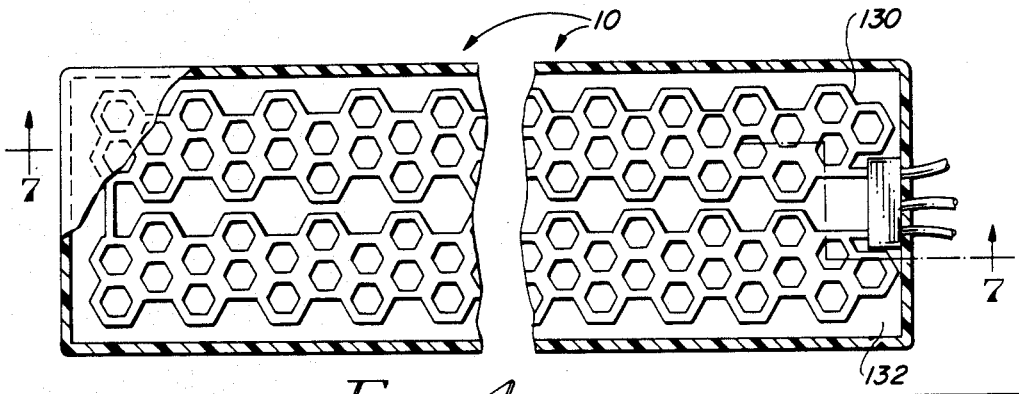
FIG. 4 is a top view of a single heating pad in a preferred embodiment of the invention, with a protective covering partially broken away.
Figure 7:
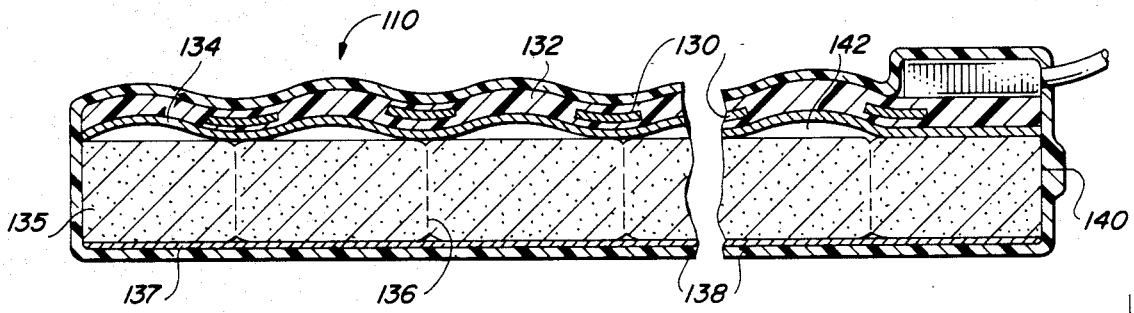
FIG. 7 is a sectional view taken through line 7—7 of FIG. 5.

FIGS. 4 and 7 show another preferred embodiment of the present invention. As in the previous embodiment, the heating pad 110 comprises a layer of resistive material 130 embedded in a layer of electrical insulation material 132, a first layer of reflective material 134, a thermal barrier layer 135 with notches 136, a second layer of reflective material 137, and a waterproof sheath 138 having an evacuation orifice 140. In this embodiment, however, the electrical resistive material 130 is embedded in a "honeycomb" pattern into the electrical insulating layer 132. The "honeycomb" pattern, as shown in FIG. 3, consists of a plurality of electrically resistive paths which are connected in parallel to one another and form a grid-like pattern of regular polygons, preferably hexagons. The hexagonal pattern has been found to ensure the most even distribution of heat. In addition, the layer of reflective material is embossed in such a way as to form a plurality of air pockets 142 between the reflective layer 134 and a thermal barrier 135. The dead air space defined by each of the pockets 142 creates an extra layer of thermal insulation in addition to the insulation provided by the barrier layer 135. Reflective layer 137 may also optionally be embossed (not shown). In order to prevent the air pockets from collapsing under the weight of water in the waterbed mattress, it is necessary that the reflective layer 134 be constructed from a material which is relatively strong in compression. One material which has been found suitable for this purpose is the product marketed under the name Polar Shield by Reynolds Aluminum Co., which consists of a Mylar sheet embedded in aluminum, although other reflective materials could also be used.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A heating pad for placement under the mattress of a waterbed, said pad comprising:

an upper layer consisting of an electrically resistive material embedded in a sheet of electrical insulating material, said resistive material defining a continuous path along which electrical current is conducted and converted into heat;

a lower layer consisting of a thermal insulating material, said lower layer being placed below said upper layer and acting as a barrier for reducing heat loss through the bottom of said pad;

a bottom layer placed under said lower layer and consisting of a heat reflective layer for reflecting heat generated in said upper layer upwardly through the waterbed mattress; and further including an intermediate layer between said upper layer and said lower layer, said intermediate layer consisting of a heat reflective material for reflecting heat generated in said upper layer upwardly through the waterbed mattress.

2. The heating pad of claim 1, in which said intermediate layer is embossed in such a way as to form pockets of air beneath the paths of resistive material, said pockets of air providing an additional layer of thermal insulation for further reducing heat loss through the bottom of the pad.

3. The heating pad of claim 1, further comprising a waterproof sheath encasing all of said layers.

4. The heating pad of claim 3, in which said waterproof sheath comprises an evacuation orifice through which a source of suction may be applied for removing air from said lower layer.

5. The heating pad of claim 1, further including means for connecting said heating pad in parallel with at least one additional heating pad and a thermostat.

6. The heating pad of claim 1, in which the continuous path of resistive material of said upper layer defines a repetitive pattern of regular polygons.

7. The heating pad of claim 6, in which said regular polygons are hexagons.

8. A heating pad for placement under the mattress of a waterbed, said pad comprising:

an upper layer consisting of an electrically resistive material embedded in a sheet of electrical insulating material, said resistive material defining a continuous path along which electrical current is conducted and covered into heat;

a lower layer consisting of a thermal insulating material, said lower layer being placed below said upper layer and acting as a barrier for reducing heat loss through the bottom of said pad, said lower layer being notched for greater flexibility; and a bottom layer placed under said lower layer and consisting of a heat reflective layer for reflecting heat generated in said upper layer upwardly through the waterbed mattress.

9. A heating unit for placement under the mattress of a waterbed, said unit comprising:

a plurality of heating pads electrically interconnected in parallel with one another;

a plurality of heat sensors, one heat sensor associated with each heating pad, said sensors being electrically interconnected in series with one another;

a switch means connected in parallel to said heating pads, said switch means applying voltage to said heating pads when closed;

a thermostat connected in series to said heat sensors, said thermostat controlling energization of said switch means; and a plurality of lead wires connecting said pads and said sensors to said thermostat and a power supply;

whereby electrical power is supplied to said heating pads only when all of said sensors detect that the temperature of the waterbed mattress has dropped below a predetermined value.

10. The heating unit of claim 9, in which a sheet of reflective material underlies each of said heating pads, said sheet having upstanding edges which enable said sheet to serve as a liner.

11. The heating unit of claim 9, in which each of said pads comprises:

an upper layer consisting of an electrically resistive material embedded in a sheet of electrical insulating material, said resistive material defining a plurality of paths along which electrical current is conducted and converted into heat, said path being connected in parallel to one another and defining a gridlike pattern; and a lower layer consisting of a thermal insulating layer, said lower layer being placed below said upper layer and acting as a barrier for reducing heat loss through the bottom of said pad.

12. The heating unit of claim 11, in which said gridlike pattern on the upper layer of each of said pads defines a repetitive pattern of regular polygons.

13. The heating unit of claim 12, in which said regular polygons are hexagons.

14. The heating unit of claim 11, in which each of said pads further comprises an intermediate layer between said upper layer and said lower layer, said intermediate layer consisting of a heat reflective layer for reflecting heat generated in said upper layer upwardly through the waterbed mattress.

15. The heating unit of claim 14, in which each of said pads further comprises a waterproof sheath encasing said upper, lower, and intermediate layers.

16. The heating unit of claim 14, in which said intermediate layer of each of said pads is embossed in such a way as to form pockets of air beneath the paths of resistive material, said pockets of air providing an additional layer of thermal insulation for further reducing heat loss through the bottom of said pad.

17. The heating unit of claim 11 or 14, in which each of said pads further includes a bottom layer placed under said lower layer, said bottom layer consisting of a heat reflective material for reflecting heat generated in said upper layer upwardly through the waterbed mattress.

18. The heating unit of claim 17, in which each of said pads further comprises a waterproof sheath encasing all of said layers.

19. The heating unit of claim 17, in which said intermediate layer of each of said pads is embossed in such a way as to form pockets of air beneath the paths of resistive material, said pockets of air providing an additional layer of thermal insulation for further reducing heat loss through the bottom of said pad.

20. The heating unit of claim 11, in which each of said pads further comprises a waterproof sheath encasing said upper and lower layers.

21. The heating unit of claim 9, in which all of said lead lines connecting said heating pads and said sensors to said thermostat and said power supply are incorporated into a single cable.

22. The heating unit of claim 9, in which each of said heating pads comprises:

an upper layer consisting of an electrically resistive material embedded in a sheet of electrical insulating material, said resistive material defining a continuous path along which electrical current is conducted and converted into heat; and a lower layer consisting of a thermal insulating material, said lower layer being placed below said upper layer and acting as a barrier for reducing heat loss through the bottom of said pad.

23. The heating unit of claim 22, in which each of said pads further includes an intermediate layer between said upper layer and said lower layer, said intermediate layer consisting of a heat reflective layer for reflecting heat generated in said upper layer upwardly through the waterbed mattress.

24. The heating pad of claim 23, in which each of said pads further comprises a waterproof sheath encasing said upper, lower, and intermediate layers.

25. The heating unit of claim 22 or 23, in which each of said pads further comprises a bottom layer placed under said lower layer, said bottom layer consisting of a heat reflective material for reflecting heat generated in said upper layer upwardly through the waterbed mattress.

26. The heating unit of claim 25, in which each of said pads further comprises a waterproof sheath encasing all of said layers.

27. The heating unit of claim 22, in which each of said pads further comprises a waterproof sheath encasing said upper and lower layers.

28. The heating unit of claim 22, in which said continuous path in said upper layer of each of said pads defines a serpentine pattern.

29. A heating unit for placement under the mattress of a waterbed, said unit comprising:

a plurality of heating pads electrically interconnected in parallel with one another;

a plurality of heat sensors, one heat sensor associated with each heating pad, said sensors being electrically interconnected in parallel with one another;

a plurality of switch means, one switch means connected in series with each heating pad, said switch means applying voltage to said heating pads when closed;

a thermostat electrically interconnected in parallel between said heat sensors and said switch means, said thermostat controlling energization of each of said switch means; and a plurality of lead lines connecting said heating pads and said sensors to said thermostat and a power supply;

whereby electrical power may be supplied to any one of said heating pads when said sensor associated with said any one heating pad detects that the temperature in a portion of the mattress near said pad has dropped below a predetermined value, said electrical power being supplied to said pad independently of the condition of the other pads.

30. The heating unit of claim 29, in which all of said lead lines connecting said heating pads and said sensors to said thermostat and said power supply are incorporated in a single cable.

31. The heating unit of claim 29, in which each of said heating pads comprises:

an upper layer consisting of an electrically resistive material embedded in a sheet of electrical insulating material, said resistive material defining a continuous path along which electrical current is conducted and converted into heat; and a lower layer consisting of a thermal insulating material said lower layer being placed below said upper layer and acting as a barrier for reducing heat loss through the bottom of said pad.

32. The heating unit of claim 29, in which each of said heating pads comprises:

an upper layer consisting of an electrically resistive material embedded in a sheet of electrical insulating material, said resistive material defining a plurality of paths along which electrical current is conducted and converted into heat, said path being connected in parallel to one another and defining a gridlike pattern; and a lower layer consisting of a thermal insulating layer, said lower layer being placed below said upper layer and acting as a barrier for reducing heat loss through the bottom of said pad.

33. The heating unit of claim 31 or 32, in which each of said pads further comprises an intermediate layer between said upper layer and said lower layer, said intermediate layer consisting of a heat reflective layer for reflecting heat generated in said upper layer upwardly through the waterbed mattress.

34. The heating unit of claim 33, in which each of said pads further comprises a bottom layer placed under said lower layer, said bottom layer consisting of a heat reflective layer for reflecting heat generated in said upper layer upwardly through the waterbed mattress.

35. The heating unit of claim 33, further comprising a waterproof sheath encasing all of said layers.

* * * * *